US005564174A

United States Patent [19]

Rovellini et al.

[11] Patent Number: 5,564,174

[45] Date of Patent: Oct. 15, 1996

[54] CRIMPING PROCESS AND A FEED DEVICE THEREFOR HAVING CONSTANT FORCED CONTACT FOR CRIMPING YARN

[75] Inventors: Marco Rovellini, Piacenza; Gianluigi Mongiorgi, Monza, both of Italy

[73] Assignee: Moroder SA, Chiasso, Switzerland

[21] Appl. No.: 289,893

[22] Filed: Aug. 12, 1994

[30] Foreign Application Priority Data

Sep. 7, 1993 [IT] Italy ..... PR93A0033

[51] Int. Cl.[6] ..... D02G 1/12

[52] U.S. Cl. ..... 28/263; 28/268; 226/172

[58] Field of Search ..... 28/250, 251, 262, 28/263, 268, 269; 226/171, 172, 181

[56] References Cited

U.S. PATENT DOCUMENTS

| | | | |
|---|---|---|---|
| 3,251,253 | 5/1966 | Eubanks | 226/172 X |
| 3,429,018 | 2/1969 | Rosenstein et al. | 28/268 X |
| 3,610,500 | 10/1971 | Brown | 226/172 |
| 5,025,538 | 6/1991 | Saleh | 28/263 |
| 5,368,212 | 11/1994 | Koch | 226/172 |

FOREIGN PATENT DOCUMENTS

| | | | |
|---|---|---|---|
| 1485529 | 6/1969 | Germany | 28/262 |

*Primary Examiner*—John J. Calvert
*Attorney, Agent, or Firm*—Darby & Darby, P.C.

[57] ABSTRACT

In a crimping process in a crimping machine therefor, a compression force on an extended length of a transiting fiber bundle is exerted by and between means for maintaining a continuous and forced contact. The means for maintaining a continuous and forced contact comprise two closed belts, each of which runs around two motorized rollers travelling at a same velocity as the fiber bundle. Pressurized air or steam is injected into the crimping machine in a same direction as an advancement direction of the fiber bundles, but in an opposite sense thereto.

15 Claims, 3 Drawing Sheets

CRIMPING PROCESS AND A FEED DEVICE THEREFOR HAVING CONSTANT FORCED CONTACT FOR CRIMPING YARN

BACKGROUND OF THE INVENTION

The invention relates to the field of production and working of chemical fibers, and in particular the process of mechanical crimping, which consists in a plastic stress deformation of each single filament of a fiber bundle.

A crimped filament is identifiable by its wave-formed aspect, the number of waves being variable per unit of length depending on the future use of the product. Two crimped categories can be distinguished: a bidimensional type (with waves in a single filament belonging basically to a same plane) and tridimensional (with the waves being oriented in space). Bidimensional crimping is obtained through mechanical crimping machines, while tridimensional crimping is obtained by the action of pressurised fluids flowing through jets, or through thermal action (in dual component fibres, for example).

Conventional mechanical crimpers comprise a crimping chamber and employ a pair of opposed motorized rollers which squeeze the fiber bundle and thus cause it to deform by compressive and bending stress; the crimping chamber being formed by two cutters of a same length close to or contacting the rollers and two lateral walls flanking the rollers and the cutters.

Since contact between fiber bundle and thrust rollers occurs along a generatrix of the rollers, high specific pressures on the fiber are necessary, which reach 40 Kg for each mm length of the generatrix.

The crimping chamber exhibits an aperture on a side opposite to the rollers through which the processed fiber exits.

In mechanical crimpers of the above-described type, working at high speeds renders adhesion of the rollers to the fiber difficult to maintain, since inertia leads to the rollers' inadequately coping with variations in fiber thickness, so that discontinuous crimping occurs and the final bundles are of poor quality.

A further drawback i s that unexpected loss of incoming fiber tension leads to snaring and tangling.

Further, the rollers can damage each other as the usually low-denier fiber bundles do not keep them apart. This effect, known as hammering, increases progressively together with speed up until the external profiles of the rollers are permanently damaged, with resulting polygonal shapes that render their efficacy geometrically impossible. Also due to the low denier, any slight pinching of the fiber between the blades of the cutters and the rollers causes breaking of the fiber bundles and an ensuing tangle in the crimping chamber.

The main aim of the invention to obviate the above drawbacks and enable a high-velocity bidimensional crimping to be achieved.

To achieve the above, it is necessary to minimise the inertias, reducing specific pressures exerted on the fiber by the rollers, and to prevent fiber shavings from infiltrating between the point of the cutter and the rollers, by pushing in an opposite direction.

BRIEF SUMMARY OF THE INVENTION

The stated aims are fully attained by the crimping process of the invention, which is characterised as set out in the following claims, and especially in that the thrust on the fiber bundle occurs on surfaces of any length in the direction of the bundle.

The invention also discloses a crimping machine, comprising two opposite belts translating at the same velocity as the fiber bundle and exerting a thrusting action thereon over a certain continuous tract of the same.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which.

DESCRIPTION OF THE PREFERRED EMBODIMENTS

With reference to the figures of the drawings, 1 denotes the means for crimping fiber bundles, which means form a constituent part of a crimping machine.

The means for crimping 1 comprise two pairs of motorized rollers 2 and 3 about each of which pairs runs a thin loop belt 4, preferably made of stainless steel.

One of the roller pairs is fixed while the other can translate with respect to the fixed pair up to a position where the two belts run coupled together along a straight tract 4*a*: it is through this straight tract 4*a* that the fiber bundle to be crimped passes.

The fibers are delivered by the belts 4 to a crimping chamber, denoted by 5 in the figures, but lacking a lateral closing wall, which has been removed to afford a clear view.

Figure 1:
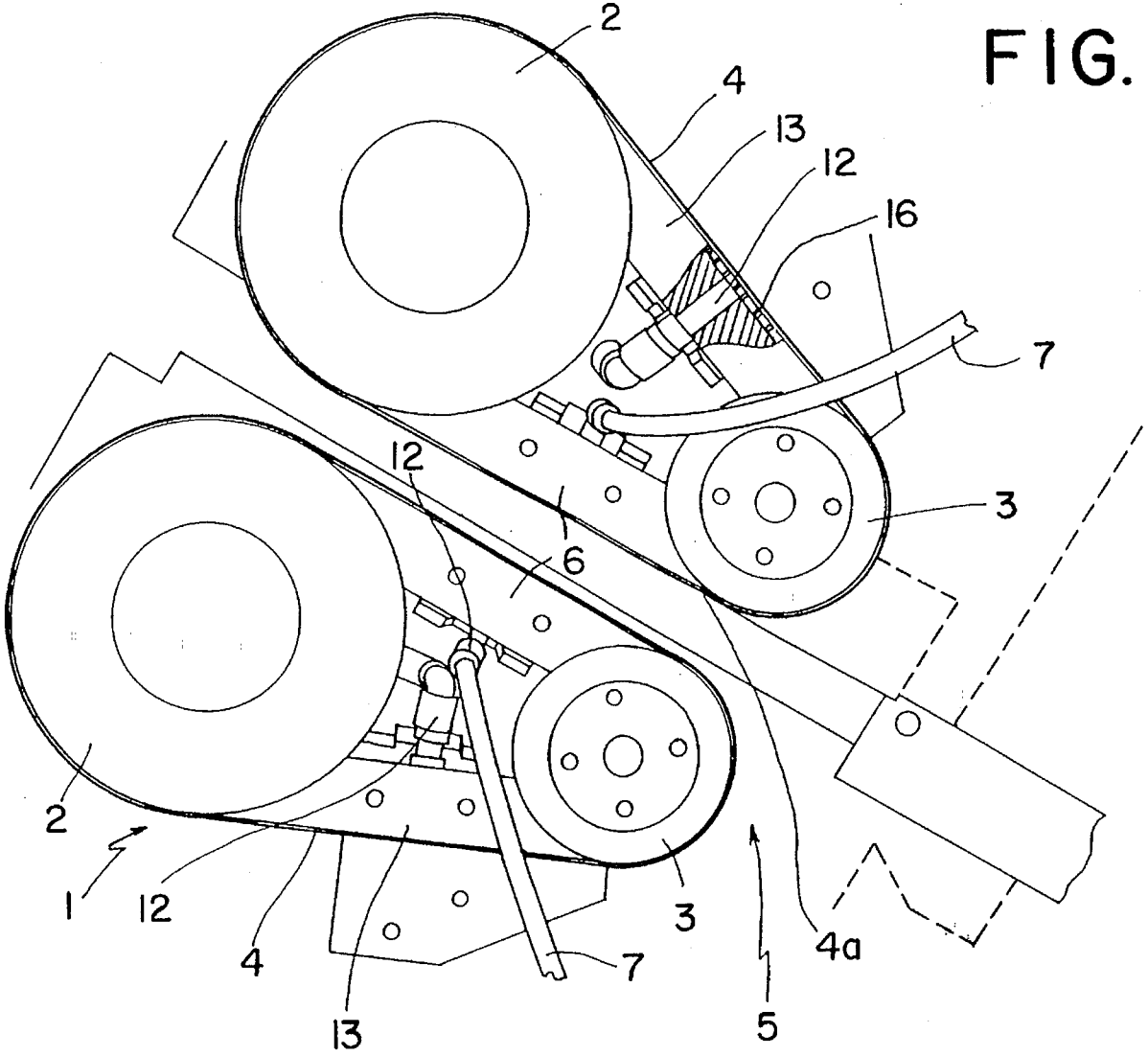
FIG. 1 is a lateral view of means for crimping the fiber bundles in an open position.
Figure 2:
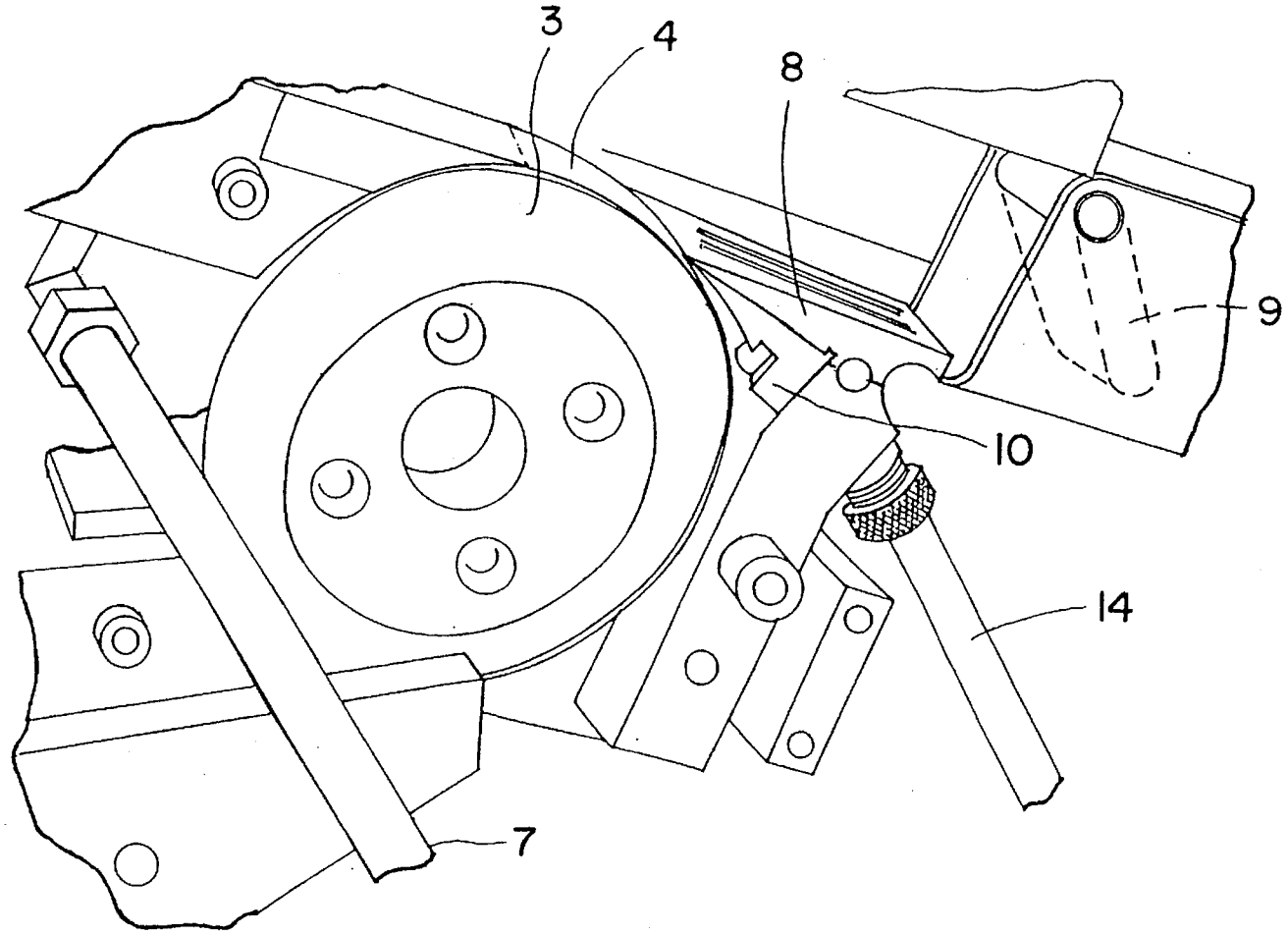
FIG. 2 is a detail of the crimper in the crimping chamber area, in lateral view.
Figure 3:
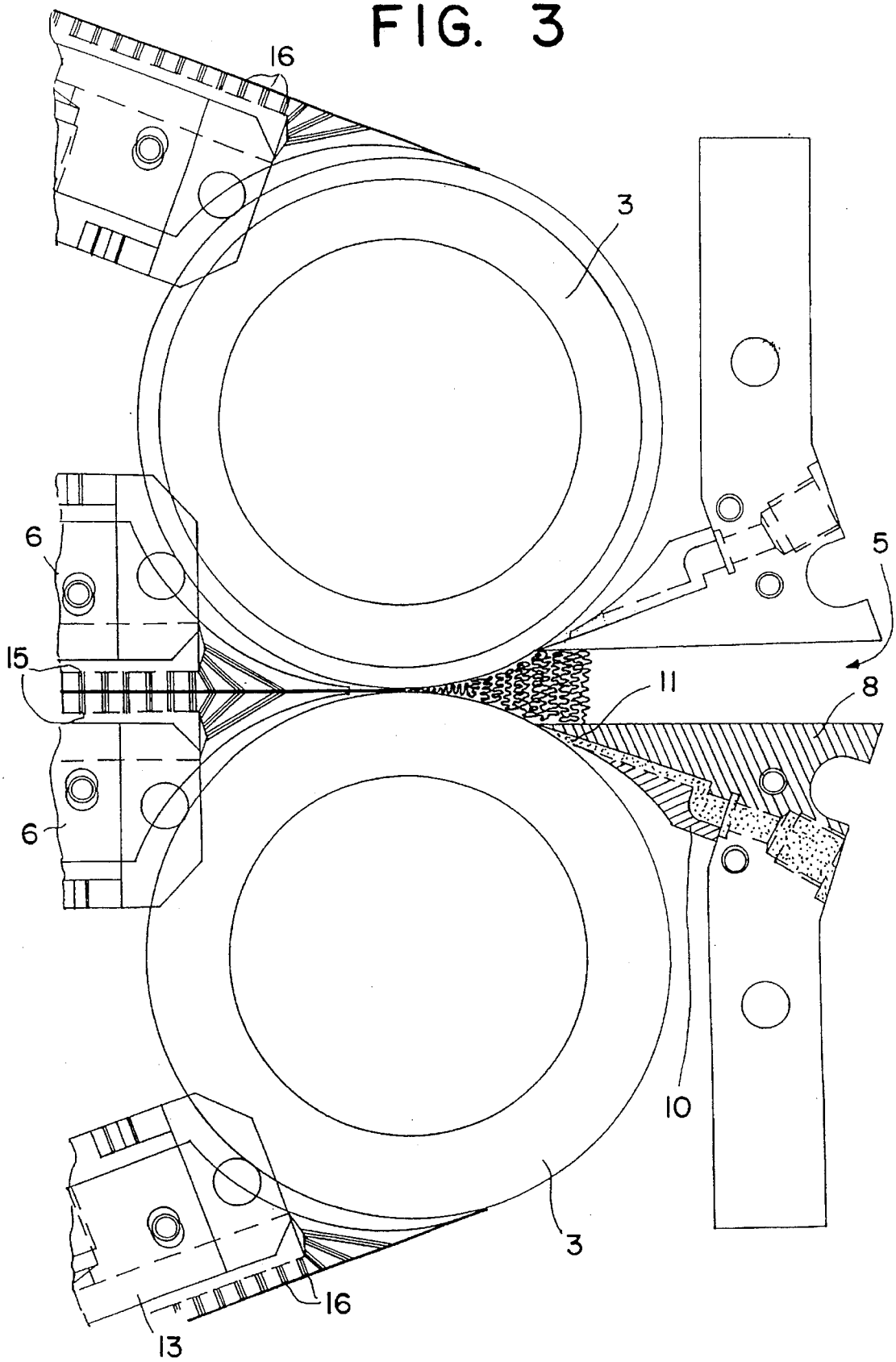
FIG. 3 is a section of the crimping chamber evidencing the "anti-pinch" means acting in an opposite direction to the fiber bundle flow direction.

To guarantee continuous forced contact between the belts 4 and the fiber bundle, the belts are forced by a pressurized fluid (for example, air or steam at up to 12 bars pressure) which is introduced through pipes 7 and distributed along the belts through first distributors 6; said distributors 6, shown in more detail in FIG. 3, comprise for example a plurality of fluid exit holes 15.

The belts contact the fiber bundle like a flexible membrane under the effect of gas pressure, and fluctuate while adhering to the fiber: thus the inertia forces are minimized and the means for crimping quickly adapt to random variations in the thickness of the fiber bundles transiting between them.

The belts travel at the same speed as the fiber bundle coming from a fiber bundle producing machine.

To help further with the belt 4 tension, a further pressurized fluid system is provided, through pipes 12 and second distributors 13. The distributors 13 are preferably the same as the distributors 6 and like before, holes 16 are provided for the fluid exit.

The pressurized fluid feed (not illustrated) is such that the distributors 6 and 13 can be activated independently of each other: the first guarantee a thrust against the fiber bundle while the second maintain a correct tensioning of the belts 4.

8 denotes one of the cutters of the crimping chamber, while g denotes an oscillating wall generating an opposition force to the fiber bundle, thus performing the crimping operation. Below the cutter 8 is situated a hollow wedge-shaped element 10 terminating in an aperture (a slit or a series of holes), which aperture a11 is arranged parallel to the fiber bundle and, through a pipe 14, introduces pressurized air or steam (up to 20 bars pressure) between the cutter 8 and the belt 4, in a tangential direction to the direction of the rollers 2 and 3, that is to say in the same direction as the advancement direction of the fiber bundle, but in an opposite sense, such as to prevent infiltration of fiber shavings between the cutter point and the belt.

The pipe 14, together with the wedge-shaped element 10 and the aperture 11 constitute anti-pinch means for introducing air or steam in the crimping chamber in an opposite direction to that of the fiber bundle flow.

If we take the term "crimping chamber" to include the straight area 4*a* between the belts, it can be said that the chamber is in fact parallelepiped and of any desired length (not zero), in the direction of the fiber bundle, of which at least two sides travel at the same speed as the incoming fiber bundle.

A further embodiment of the invention has the lateral walls of the crimping chamber provided with a longitudinal slit which extends over all of the crimping chamber.

With the invention, a greater bidimensional crimping speed is made possible, thanks to the considerable and continuous contact between the thrust means and the fiber bundle, and also thanks to the use of a pressurised fluid (instead of the usual tensioning rollers) both to keep the belts 4 tight and to maintain constant adhesion between thrust means and fiber bundles, all of which results in an improved crimping quality.

The injection of air or steam into the crimping chamber between the cutter blades and the belt also helps to avoid blocking due to shaving infiltration between cutter and belt.

What is claimed:

1. A machine for crimping fibers in a bundle comprising:

a crimping chamber;

means for engaging the bundle over a portion of a length thereof in an elongated zone and applying a compressive force to the bundle while moving the bundle through the zone into the crimping chamber wherein said means for engaging comprises a pair of elongated belts each in a continuous loop between which the bundle passes.

2. A machine as in claim 1 wherein said means for engaging travels at substantially the same linear velocity as the bundle is moved through the elongated zone.

3. A machine as in claim 1 further comprising means for actuating the belts with a force thrusting them toward each other for applying the compressive force to the bundle.

4. A machine as in claim 3 further comprising means for rotating at least one of the belts to forcibly move the bundle through the elongated zone.

5. A machine as in claim 1 wherein said actuating means further comprises first distributors of pressurized fluid for maintaining the engaging means in a state of forced contact with the bundle, said first distributors having a plurality of holes through which the pressurized fluid is injected against a said belt for control of the engaging means.

6. A machine as in claim 3, wherein said actuating means further comprises first distributors of pressurized fluid having a plurality of holes through which the pressurized fluid is injected to the rear face of at least one of said belts for maintaining the engaging means in a state of forced contact with the bundle.

7. A crimping machine as in claim 6 further comprising second distributors of pressurized fluid for keeping the two belts correctly tensioned.

8. A machine as in claim 3, wherein the two closed belts are of stainless steel.

9. A machine as in claim 1 further comprising means for introducing pressurized fluid in said crimping chamber along the path of travel of the bundle in a direction opposite to the travelling direction of the bundle.

10. A machine as in claim 9, further comprising doctor blades in said crimping chamber under which the bundle passes, said means for introducing pressurized fluid in said crimping chamber comprising a wedge-shaped hollow element having a narrow end with an aperture for exit of the pressurized fluid under said doctor blades.

11. A method for mechanically crimping fibers in a bundle of fibers comprising the steps of engaging the bundle in an elongated zone and applying a compressive force thereto along the length of the zone, and moving the bundle through said elongate zone, with the compressive force being applied, into a crimping chamber wherein said step of engaging comprises providing a pair of belts with spaced and opposing surfaces that define the elongate zone.

12. A method as in claim 11 further comprising the step of applying a force to thrust said belts toward each other to establish the compressive force.

13. A method as in claim 12 wherein the moving step comprises rotating at least one of said belts to move the bundle through the elongated zone while the compressive force is applied thereto.

14. A method as in claim 13 wherein the said at least one belt is moved linearly at substantially the same linear speed as the speed of movement of the bundle.

15. A method as in claim 12 further comprising the step of applying a stream of air to the bundle along its path of travel in a direction opposite to the movement of the bundle as it enters the crimping chamber.

* * * * *

UNITED STATES PATENT AND TRADEMARK OFFICE

CERTIFICATE OF CORRECTION

PATENT NO. : 5,564,174

DATED : October 15, 1996

INVENTOR(S) : Marco ROVELLINI et al.

It is certified that error appears in the above-indentified patent and that said Letters Patent is hereby corrected as shown below:

On the title page:

Item [30], Foreign Application Priority Data, change "PR93A0033" to --PR93A000033--.

Signed and Sealed this

First Day of April, 1997

Bruce Lehman

BRUCE LEHMAN

*Commissioner of Patents and Trademarks*

*Attest:*

*Attesting Officer*